United States Patent [19]

Schnepfe, Jr. et al.

[11] 4,147,216

[45] Apr. 3, 1979

[54] PENETRATOR/NOZZLE ARRANGEMENT

[75] Inventors: Robert W. Schnepfe, Jr., Upperco; Laban R. Lowe, Sr., White Hall, both of Md.

[73] Assignee: AAI Corporation, Cockeysville, Md.

[21] Appl. No.: 795,478

[22] Filed: May 10, 1977

[51] Int. Cl.[2] ..... A62C 31/22; B67B 7/24

[52] U.S. Cl. ..... 169/70; 30/123.3; 166/297; 222/5; 239/271

[58] Field of Search ..... 239/271; 169/70, 62; 222/5, 80, 85, 87; 141/329; 128/214.4, 218 F; 27/24 R; 166/55.2, 55.3, 297, 298; 83/98-100; 30/123.3; 53/112 A

[56] References Cited

U.S. PATENT DOCUMENTS

| | | | |
|---|---|---|---|
| 2,857,005 | 10/1958 | Medlock | 169/62 |
| 2,861,406 | 11/1958 | Holsman et al. | 53/112 A X |
| 3,245,200 | 4/1966 | Shaw | 141/329 X |
| 3,572,334 | 3/1971 | Petterson | 128/214.4 |
| 3,826,256 | 7/1974 | Smith | 128/214.4 |

FOREIGN PATENT DOCUMENTS

| | | | |
|---|---|---|---|
| 587639 | 5/1947 | United Kingdom | 239/271 |

*Primary Examiner*—Robert B. Reeves
*Assistant Examiner*—Andres Kashnikow
*Attorney, Agent, or Firm*—Reginald F. Pippin, Jr.

[57] ABSTRACT

A penetrator/nozzle arrangement, particularly for enabling fighting of fires in aircraft and other difficult access target units, in which the penetrator/nozzle arrangement has a telescopic nozzle formed by a spray nozzle tube section telescopically slidable on a concentric feed tube, with a cylindrical cutter mounted for sliding movement about the nozzle and toward a target unit. A cartridge is fired to drive the cutter toward the forward spray end of the nozzle, thereby cutting the effective skin of a target and enabling the nozzle to be moved therethrough with its forward spray discharge end extending into the target interior zone for passage of fluid, powder or other desired agent through the nozzle into the target interior.

10 Claims, 8 Drawing Figures

PENETRATOR/NOZZLE ARRANGEMENT

This invention relates to nozzle arrangements for dispensing fluids or other agents, and more particularly to a penetrator/nozzle arragement which enables cutting of the effective skin of a skin-enclosed target prior to nozzle insertion, and insertion of a nozzle through the cut opening.

It is a feature that such an arrangement is provided without necessity for employing a sharp pointed penetrating nozzle or for exertion of impact penetration by the nozzle.

It is a further feature of the invention to provide a specialized fire-fighting device for extinguishing fires that occur in inaccessible areas of aircraft, and other units or assemblies, including automobiles, trucks, railroad cars, etc., such as in compartments, nacelles, radomes, behind panels, etc. of such aircraft or other units or assemblies.

The primary functions of the device are the piercing of the skin or panel covering of the aircraft compartment, nacelle, radome, or other target unit or assembly; the insertion of a nozzle through the pierced hole; and the enablement of application of agent to the fire through the hole-inserted nozzle; all with a minimum of damage to the aircraft or other unit or assembly.

In operation, a nozzle, which serves as a trigger, is pressed against the skin or other covering of a panel, compartment, radome, etc., desired to be penetrated, and a blank propellant gas generating cartridge is fired by longitudinal relative motion between the forwardly pressed barrel and the nozzle, the gases from the fired cartridge accelerating a concentric tubular cutter forwardly in concentric relation between the barrel and the nozzle, which cutter thereby cuts and penetrates the skin and enables the nozzle to be moved through the cut opening by passage within the tubular cutter. Fluid or other suitable agent may be introduced into the target unit interior through the thus inserted nozzle.

It is an important safety feature that the nozzle forms the trigger for the penetrator/nozzle assembly, thus preventing the inadvertent manual actuation of the type that frequently occurs with finger-actuated triggers, and further generally assuring the presence of a relatively rigid target or other element in front of the nozzle at the time of firing.

Still other objects, features and advantages of the invention will become apparent from a reading of the following detailed description of a preferred physical embodiment, taken in conjunction with the accompanying drawings, wherein.

Figures 1, 8:
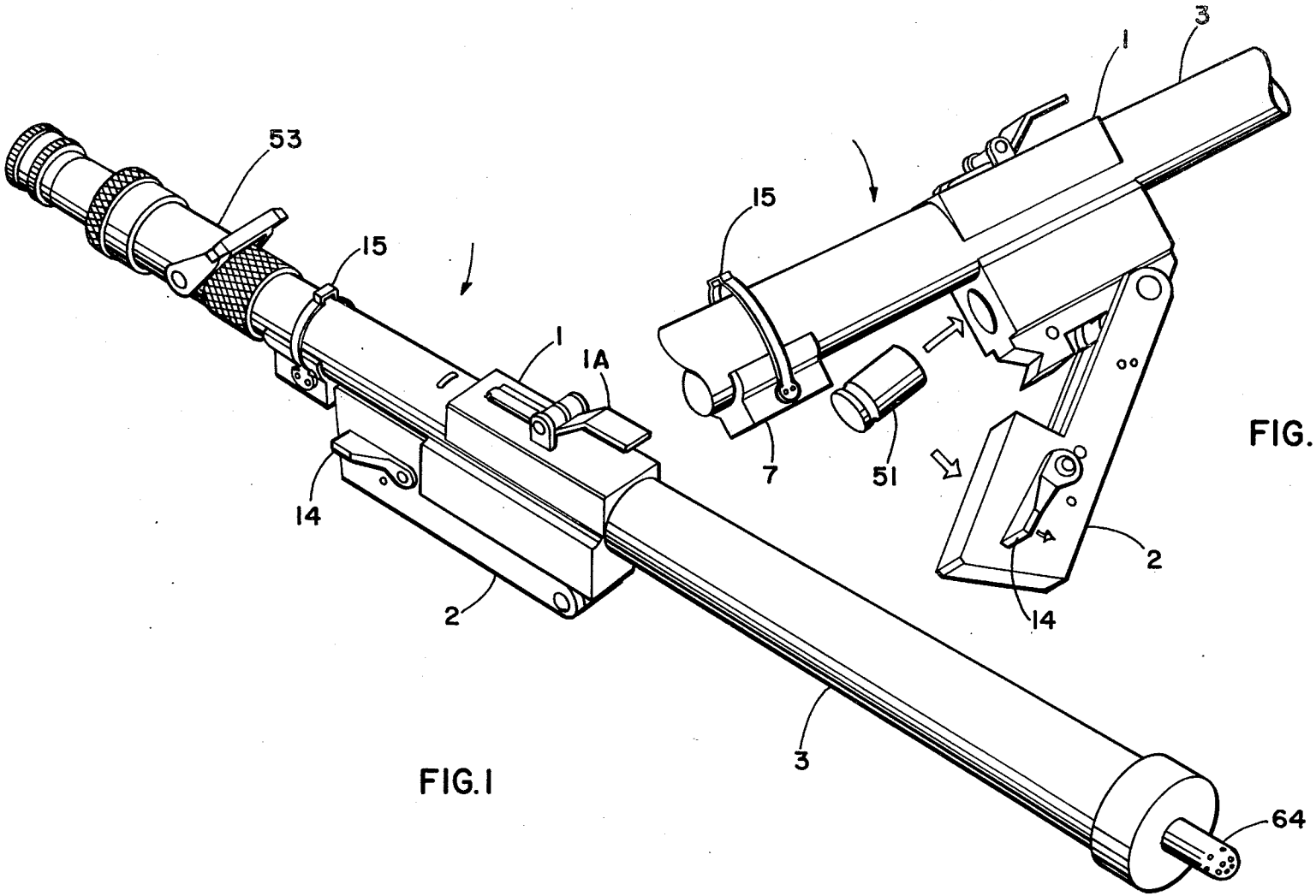
FIG. 1 is a perspective view of a penetrator/nozzle arrangement according to the invention.
FIG. 8 is a generalized schematic view in perspective, illustrating the opening of the breech assembly and the insertion of a cartridge into the cartridge chamber.
Figure 2:
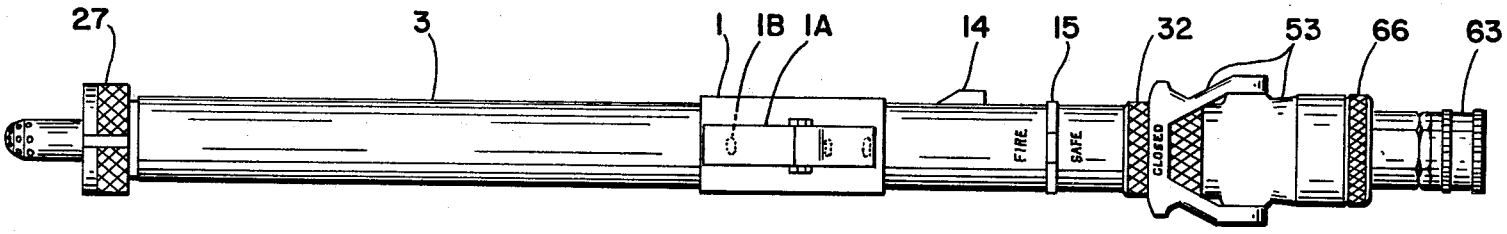
FIG. 2 is a plan view of the penetrator/nozzle arrangement of FIG. 1.
Figure 3:
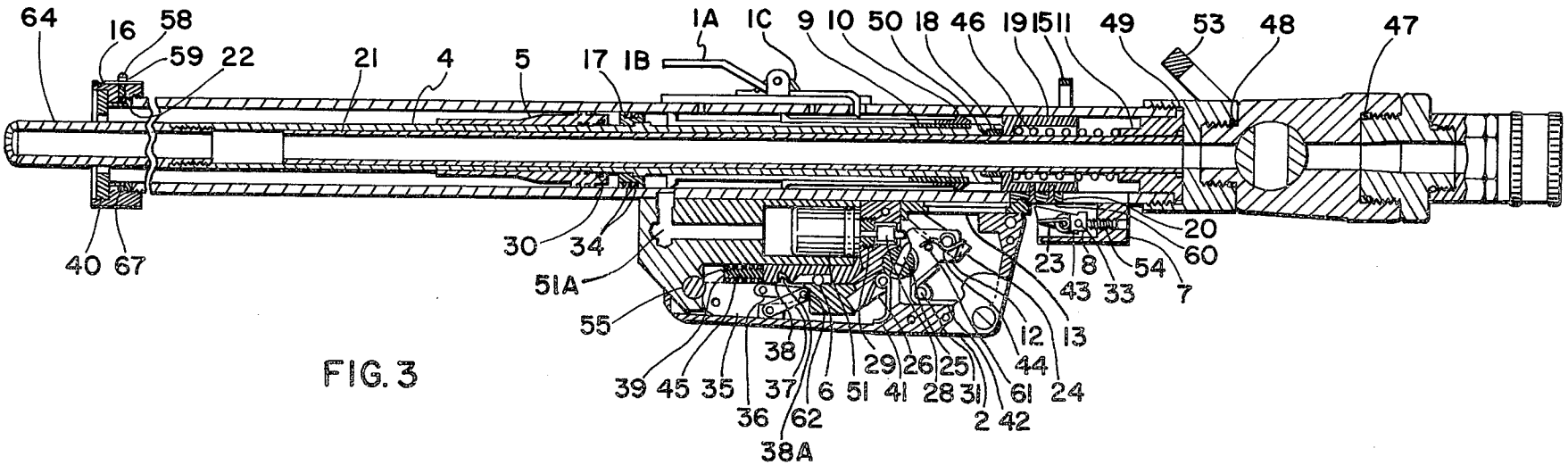
FIG. 3 is a longitudinal section view of the penetrator/nozzle arrangement prior to firing.
Figure 4:
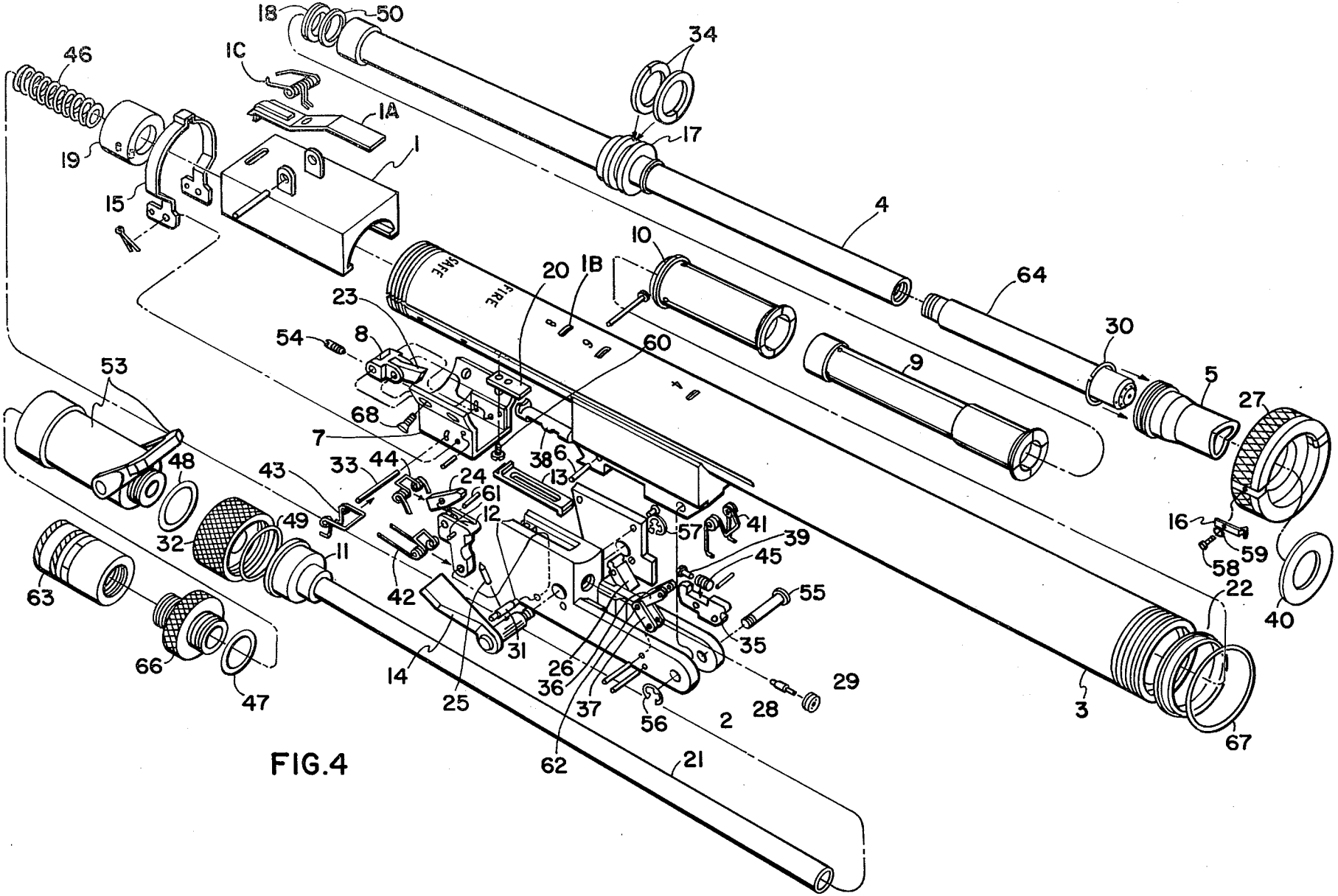
FIG. 4 is an exploded view of the penetrator/nozzle arrangement.
Figure 5:
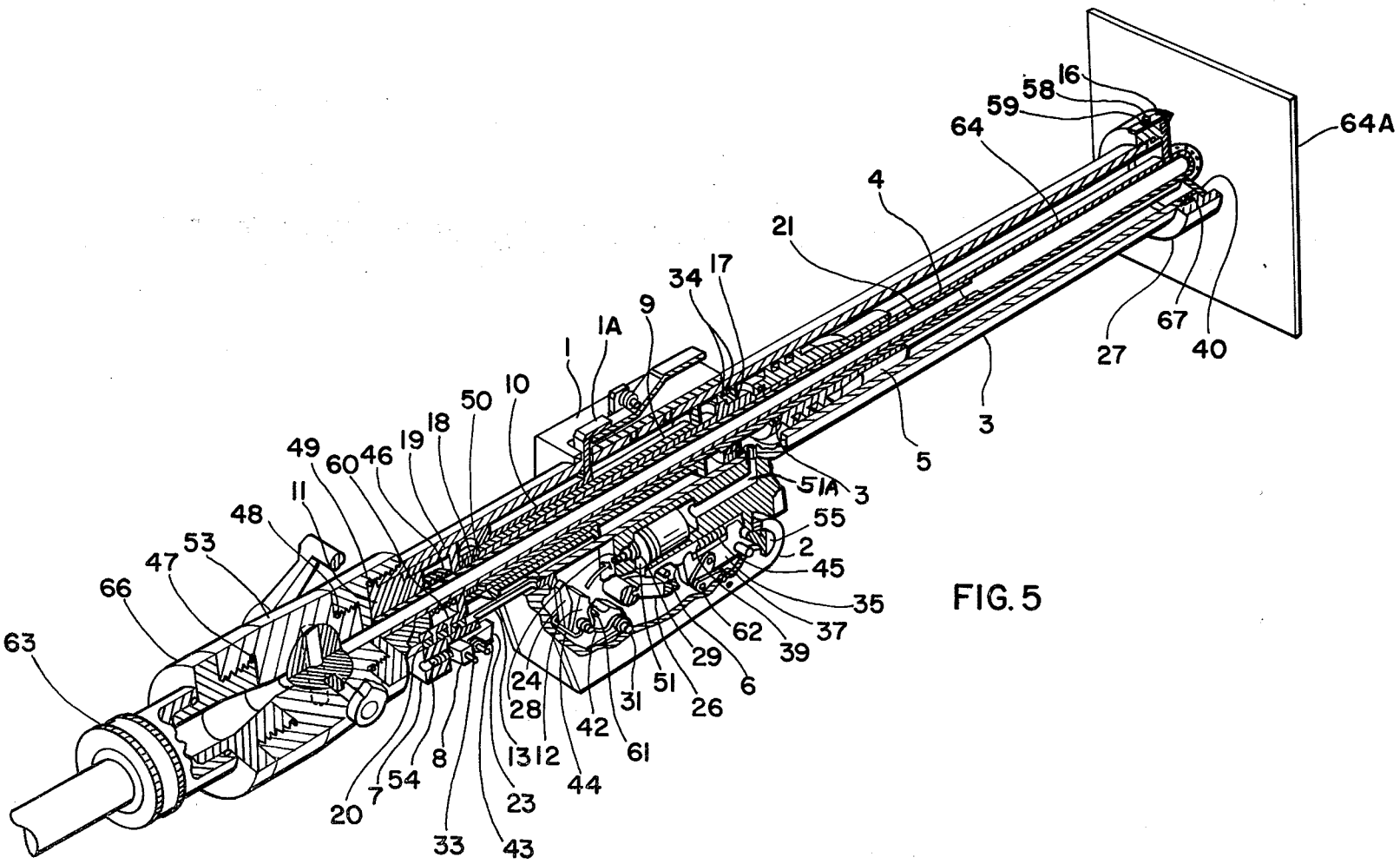
FIG. 5 is a perspective view, partially cut away, showing the penetrator/nozzle arrangement in the process of being pushed against a target for firing and insertion of the nozzle therewithin.
Figure 6:
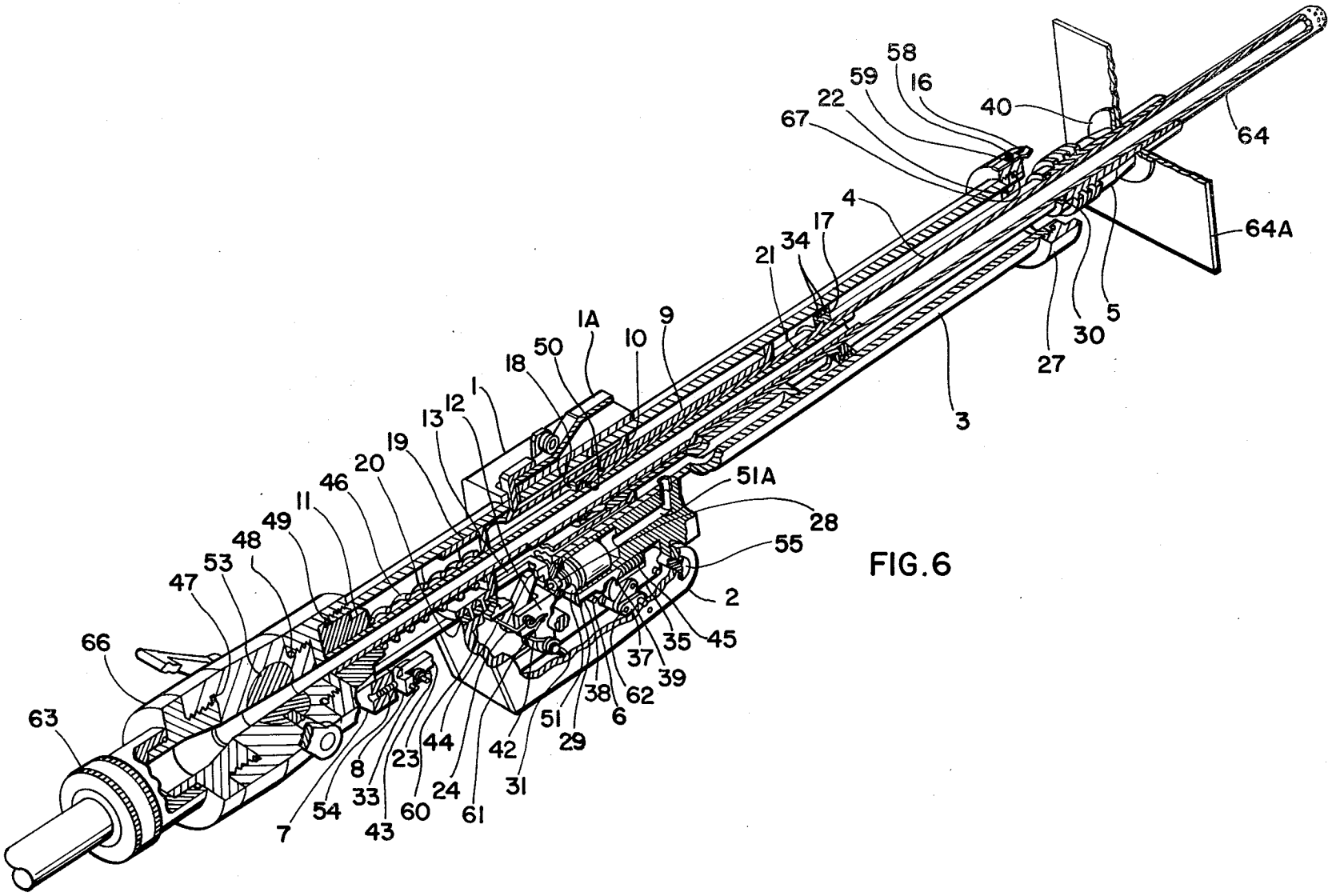
FIG. 6 is a view similar to FIG. 5, shown in the position after firing and with the nozzle inserted within the target.
Figure 7:
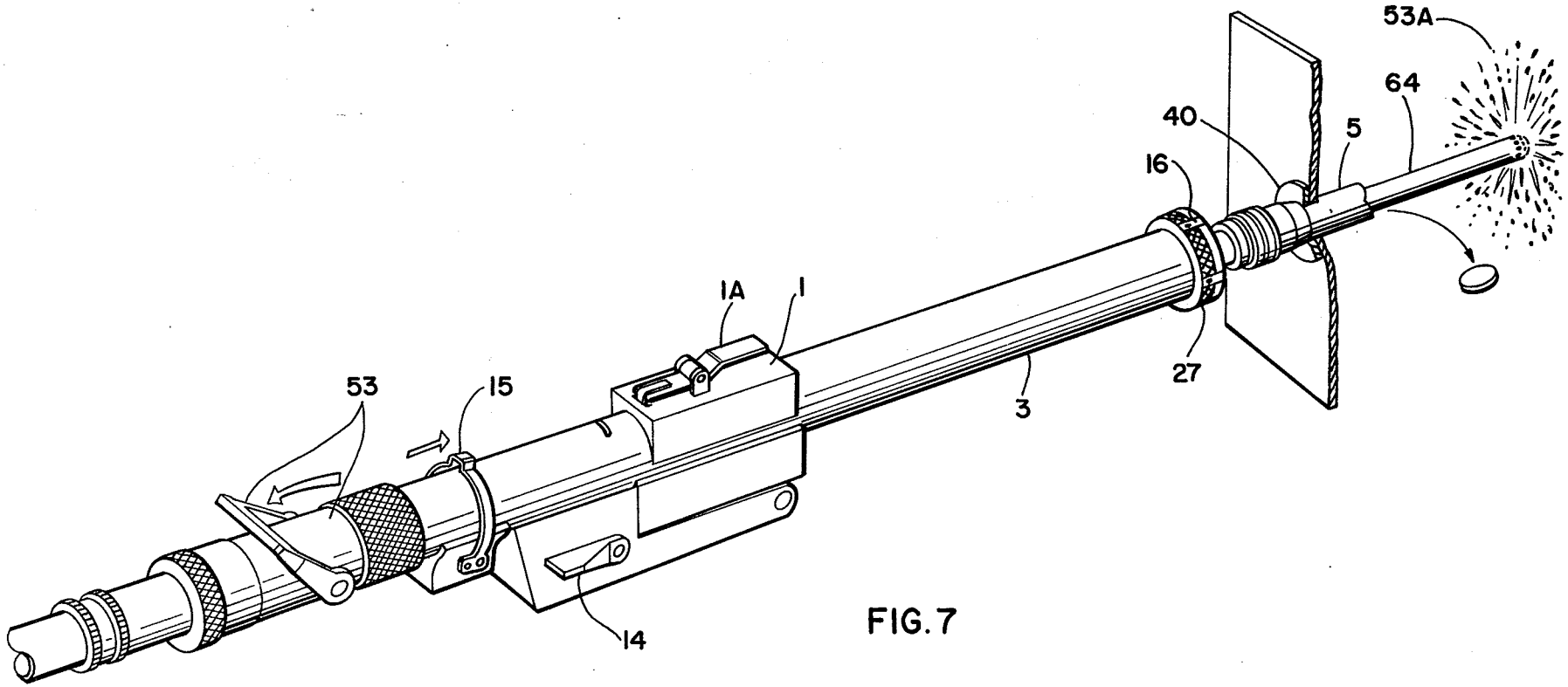
FIG. 7 is a perspective view showing the penetrator/nozzle arrangement with the nozzle in its inserted agent-dispensing position within a target, and with fluid being dispensed into the target interior.

Referring now in detail to the Figures of the drawings, a penetrator/nozzle arrangement is provided, as illustrated in the various FIGS. 1–8, including a barrel 3 having a telescopic agent-dispensing nozzle 4, 21 telescopically mounted in concentric relation therein, and with a tubular cutter unit 5 mounted in concentric, suitably generally gas-sealed, freely slidable, relation within the barrel and about the nozzle 4, 21 for forcible discharge through the forward muzzle end of the barrel 3.

The telescopic nozzle 4, 21 includes a forward discharge nozzle section generally indicated at 4, telescopically slidable in fluid-sealed relation on a fixed rear feed tube section generally indicated at 21. The forward nozzle section 4 includes a replaceable tip 64, which preferably has agent dispersion apertures therein suitably arranged for desired agent dispersion within a target interior after cutting of the target skin by the cutter 5, and insertion of the nozzle section 4 (including dispersion nozzle tip 64) within the hole formed by the cutter 5.

An agent-flow-control valve generally indicated at 53 in suitably connected in fluid-sealed relation between the rear end of nozzle feed tube 21 and a suitable coupling 63 which enables connection of the penetrator/-nozzle arrangement to a supply hose or other suitable agent supply means.

A break-apart breech assembly, generally indicated at 2, is provided, within which is carried a firing mechanism for effecting forcible discharge of the cutter 5 through the muzzle end of the barrel at a velocity suitable for penetration of the skin of a target and embedment of the cutter 5 within the target skin, with a washer 40, removably carried in the muzzle end of the barrel 3, serving as a securing stop for the cutter 5.

While the novel concentric cutter and nozzle arrangement of this invention may be employed with a conventional finger-actuated trigger firing arrangement, it is preferred and is a feature of this invention that the firing mechanism employ a trigger arrangement in which the nozzle is telescopic as above described and serves as a trigger through telescopic pressing action against a target.

In this preferred embodiment the firing mechanism is generally contained within breech assembly 2, and is operatively connected to the barrel 3 and nozzle assembly 4, 21 adjacent the rear end thereof, being actuated by a rearward movement of the nozzle 4, over the rearward portion of travel of the nozzle. A manually settable safety 15 (23, 33, 43) is provided.

The nozzle tube 4, 64 is spring-loaded forward by spring 46 over the actuating stroke, so that with the safety 15 off, a rearward push is required on the nozzle 4 to fire the cartridge 51. As the forward tip section 64 of nozzle tube 4 is pushed against a skin surface of a target T to be penetrated, the rear end of the nozzle tube 4 moves against a slidable sleeve 19 which is connected as by connector 20 and screws 60 to a sliding sear 13.

The sear 13 in turn interlocks with the hammer pawl 24 on the firing mechanism hammer 12 and, when moved backward, rotates the hammer 12. This rotation loads the hammer spring 42 about the hammer pivot pin 31. Hammer pawl 24 slips off the sear 13 as the sear moves away from the axis of rotation of the hammer assembly 12, 24, 42, 44. The hammer 12 then flies forward, powered by the loaded hammer spring 42 and strikes the firing pin 28, firing the cartridge 51. Subsequent forward movement of the sleeve 19 and sear 13 is effective to restore the sear 13 to the initial pre-fire condition with the sear 13 interlocked with pawl 24, this being effected by the sear 13 riding over the spring(44)-loaded pivoted pawl 24 during the forward return motion of the sear 13. After firing, the pawl 24 is thus cammed inward by the sear 13 and returns to its interlock position with the sear 13.

By using the nozzle itself as the actuating arm or element, a significant safety feature is realized. Accidental firing after removal of the safety, of the type which may occur with a manual finger-actuated trigger, is prevented. Further, the mechanism will not fire until the nozzle 4 is at its rearwardmost position. This insures that the nozzle seal 17 on the nozzle 4 will be aft of the gas port leading from the chamber. Accidental firing of the device with the nozzle flange seal 17 forward of the propellant gas port 51A is thus avoided.

The cartridge chamber, break action and lock, as generally shown in FIG. 8, are generally somewhat similar to those employed in a standard shotgun mechanism. The pivoted breech lock 26 is pushed downward by attached lever 14 against a bias spring, to open the action for loading and unloading, and the spent cartridge 51 is spring-ejected by spring 45 and extractor 38 from the chamber. The firing mechanism rotates downward about 90° about pivot pin 55, clear of the cartridge chamber for easy access for reloading.

A safety 15 is provided, including a spring(43)-loaded safety pawl 23 that blocks the rearward motion of sear 13 and prevents it from moving rearward and cocking the hammer 12. The safety is automatically returned into the safe position after each firing of the device.

The cutter 5 is free-sliding within the steel barrel 3 and along nozzle tube 4, and is initially removably held in position on the nozzle tube 4 by a split lock wire 30 resting in an annular groove on the nozzle tube 4 spaced forward of the nozzle seal 17 secured on the nozzle tube 4. At firing, the nozzle tube is in the position with the gas port 51A connecting in fluid flow alignment between the rear end of cutter 5 and the forward end of nozzle seal 17, and the propellant gases thus enter the barrel from port 51A between the rear end of cutter 5 and the forward end of the nozzle seal 17, and accelerate the cutter to a velocity sufficient to drive it into and through the skin of the target T. After penetration, the tapered rear section of the cutter 5 contacts the frictionally removably held aluminum washer 40, which stops the cutter from full penetration through the target skin.

The cutter 5 is a small cylindrical element, double-pointed at its forward end and tapering out at its enlarged rear end with an annular flange seal adjacent its rearmost end, which after penetration of the target material, provides a passageway for the insertion of the perforated tip 64 of nozzle 4. Tests have indicated this double point to be the best cutter surface configuration for penetration at all angles. Afer use, the nozzle is removed from the target, and the cutter is left in the target to be retrieved later if desired.

After firing, the nozzle depth adjustment 1, 1A is unlocked and the nozzle 4 is pulled outward as far as possible. The cutter is placed in the barrel at the muzzle and pushed to engage the lock wire detent 30. The nozzle is then pushed back into the barrel with the cutter attached.

The nozzle tube 4 together with agent tube 21 concentric therewith, and about which the nozzle slides in fluid-sealed relation (as by an O-ring seal 50), forms a two-piece telescoping tube assembly, the forward nozzle portion 4 (64) of which slides forward to achieve the desired depth of penetration. The forward end of nozzle 4 contains a replaceable nozzle tip 64 for the proper dissemination of the agent in a prescribed or desired pattern. As previously noted, the fixed rear inner portion or agent tube 21 is secured to the rear of the penetrator/nozzle assembly and provides a connection to the agent supply, as through coupling 63. The force used for the deployment of the nozzle to the preset depth is the pressure of the fire-fighting agent or other dispensing medium as it enters and passes through the penetrator/nozzle tube assembly 21, 4 (64).

The nozzle depth adjustment system utilizes concentric, telescoping sleeves 9 and 10 in conjunction with an external, longitudinally slidably adjustable manually set pivoted latch assembly 1, 1A, the base 1 of which is secured and slidable in longitudinal securing and guiding grooves (not shown) on barrel 3. The slidable nozzle 4 has a forward facing shoulder adjacent its rear end, which contacts the forward part of the inner sleeve 9. The inner sleeve 9 and outer sleeve 10 have shoulders which are contacted by the external latch 1A, which, it will be noted, has a forwardly tapered self-lifting cam surface on its forwardly facing face, which cam surface enables the latch to ride up over the sleeves 9, 10 during rearward motion of the sleeves, but forward motion of the sleeves therepast is prevented, unless the latch 1A is manually released. By setting the latch at the desired slot in the barrel, the appropriate shoulder on one of the sleeves will be contacted during forward motion of the nozzle 4. At firing, this acts as a stop for the nozzle 4, permitting deployment of the nozzle and sleeves only as far as the latch setting Four illustrative settings are illustrated, for four-, six-, eight- and ten-inch penetrations by way of example. If a four-inch penetration is desired, the latch 1A is set in the forwardmost position which locks the sleeves and allows only the nozzle 4 to move until hitting the inside shoulder on the inner sleeve. The latch set in the second slot allows the inner sleeve to move two inches. This, added to the four inches of travel of the nozzle 4 in the inner sleeve amounts to a six-inch penetration. If the latch is not set in any slot, the nozzle moves forward until it strikes the fixed forward stop 22 in barrel 3, thus achieving the full ten-inch penetration. Depth settings available are four, six, eight, and ten inches.

The aft section of the penetrator contains the on-off flow control valve 53 and the coupling 63 for connection of various hoses or other supply means as desired. The valve 53 may suitably be a standard ball shut-off valve manufactured by Akron Fire Fighting Equipment designated Style 1110 conforming to MIL-N-12314C, Type III, Class B. The coupling may suitably be a quick-disconnect coupling No. S6UHC16-16F manufactured by Snap-Tite, Inc.

The operator must first select the area to be penetrated. He then sets the depth selector 1, 1A for the desired penetration depth. He should determine the approximate thickness of the material and select the cartridge 51 accordingly. The breech assembly 2 is then opened and the cartridge 51 inserted into the chamber and the breech closed. The device is then ready for operation. One hand grips the forward part of the barrel 3 about six inches back from the muzzle end and the other hand grips the barrel 3 just aft of the firing mechanism. When ready to fire, the safety 15 is pushed forward with the thumb, and the nozzle 4 is pushed forward firmly against the target T. After penetration, the appropriate hose, if not already connected, is connected to the rear of the penetrator/nozzle assembly, and the agent valve 53 is then opened to dispense the agent into the target.

To ready the penetrator/nozzle assembly for reuse, the agent valve 53 is closed and the nozzle 4 removed from the cutter 5, which may remain embedded in the target T with the washer 40. The depth adjustment latch 1A is released and the nozzle 4 is pulled outward through the muzzle end of barrel 3. A new cutter 5 is inserted and secured by split lock wire 30, and the nozzle 4 is then pushed in. A new washer 40 is then inserted into the washer holder 27 with its retention springs 16. The breech assembly 2 is then opened, the spent cartridge case removed, and a new cartridge 51 inserted into the chamber. The breech assembly 2 is then closed and the penetrator/nozzle is ready for use.

While the invention has been illustrated and described with respect to a particular illustrative embodiment, it will be appreciated that various modifications and improvements may be made without departure from the scope or spirit of the invention. Accordingly, it is to be understood that the invention is not to be limited by the particular illustrative embodiment, but only by the scope of the appended claims.

We claim:

1. A penetrator/nozzle arrangement comprising
a nozzle having a discharge end,
a tubular cutter slidable as a free body projectile about said nozzle and forcibly drivable into a target at the discharge end of said nozzle,
said nozzle being telescopic,
and latent explosive energy means for imparting abrupt forward high velocity impact motion to said cutter.

2. A penetrator/nozzle arrangment comprising
a nozzle having a discharge end,
a tubular cutter slidable about said nozzle and forcibly drivable into a target at the discharge end of said nozzle,
said nozzle being telescopic,
energy means for imparting forward motion to said cutter,
and actuating means for actuating said energy means as a function of telescopic movement of said nozzle.

3. An arrangement according to claim 2,
said actuating means including a firing pin movable as a function of rearward movement of a portion of said telescopic nozzle, said firing pin being for firing a gas-propellant cartridge forming said energy means.

4. A penetrator/nozzle arrangement comprising
a nozzle having a discharge end,
a tubular cutter slidable about said nozzle and forcibly drivable into a target at the discharge end of said nozzle,
said nozzle being telescopic,
and means for actuating an energy means as a function of telescopic movement of said nozzle, to effect forward motion of said cutter.

5. A penetrator/nozzle arrangement comprising
a nozzle having a discharge end,
a tubular cutter slidable as a free body projectile about said nozzle and forcibly drivable into a target at the discharge end of said nozzle,
and latent explosive energy means for imparting abrupt forward high velocity impact motion to said cutter.

6. A penetrator/nozzle arrangement comprising
a nozzle having a discharge end,
a tubular cutter slidable about said nozzle and forcibly drivable into a target at the discharge end of said nozzle,
a barrel,
said cutter and nozzle being disposed in said barrel,
said cutter, nozzle and barrel being in concentric relation, and said cutter being longitudinally slidable within said barrel and about said nozzle,
said nozle being telescopic,
said nozzle normally extending beyond the muzzle end of said barrel and being telescopic toward the rear end of said barrel,
and means for actuating an energy source as a function of rearward telescopic movement of said nozzle, to effect forward motion of said cutter.

7. An arrangement according to claim 6,
and means for connecting the output of an energy source to said cutter, to impart forward motion to said cutter upon said actuation thereof.

8. An arrangement according to claim 7,
and valve means for controlling the flow of material through said nozzle.

9. A penetrator/nozzle arrangement comprising,
a nozzle having a discharge end,
a tubular cutter slidable about said nozzle and forcibly drivable into a target at the discharge end of said nozzle,
said nozzle being telescopic,
and means for enabling actuation of an energy means as a function of telescopic movement of said nozzle, to effect forward motion of said cutter.

10. A penetrator/nozzle arrangement comprising
a nozzle having a discharge end,
a tubular cutter slidable about said nozzle and forcibly drivable into a target at the discharge end of said nozzle,
a barrel,
said cutter and nozzle being disposed in said barrel,
said cutter, nozzle and barrel being in concentric relation, and said cutter being longitudinally slidable within said barrel and about said nozzle,
said nozzle being telescopic,
said nozzle normally extending beyond the muzzle end of said barrel and being telescopic toward the rear end of said barrel,
and means for enabling actuation of an energy source as a function of rearward telescopic movement of said nozzle, to effect forward motion of said cutter.

* * * * *